US006739561B2

(12) United States Patent
Herzog

(10) Patent No.: US 6,739,561 B2
(45) Date of Patent: May 25, 2004

(54) ANTENNA MOUNTING DEVICE

(75) Inventor: Markus Herzog, Appenzell (CH)

(73) Assignee: Huber + Suhner AG, Herisau (CH)

( * ) Notice: Subject to any disclaimer, the term of this patent is extended or adjusted under 35 U.S.C. 154(b) by 0 days.

(21) Appl. No.: 10/122,727

(22) Filed: Apr. 16, 2002

(65) Prior Publication Data

US 2002/0162924 A1 Nov. 7, 2002

(30) Foreign Application Priority Data

Apr. 17, 2001 (CH) ..... 0695/01

(51) Int. Cl.[7] ..... A47B 96/06
(52) U.S. Cl. ..... 248/218.4
(58) Field of Search ..... 248/218.4, 219.2, 248/230.5, 230.3, 231.61, 231.41, 220.22, 220.21; 343/898, 890, 892

(56) References Cited

U.S. PATENT DOCUMENTS

| | | | | | |
|---|---|---|---|---|---|
| 4,214,842 | A | * | 7/1980 | Franks | 405/191 |
| 4,300,852 | A | * | 11/1981 | Clark | 403/385 |
| 4,595,165 | A | | 6/1986 | Klingensmith et al. | |
| 4,745,412 | A | * | 5/1988 | Creaser, Jr. | 343/890 |
| 5,193,774 | A | * | 3/1993 | Rogers | 248/219.4 |
| 5,204,688 | A | * | 4/1993 | Loiseau et al. | 343/800 |
| 5,320,312 | A | * | 6/1994 | Hoenninger | 248/68.1 |
| 5,641,141 | A | * | 6/1997 | Goodwin | 248/218.4 |
| 5,787,673 | A | * | 8/1998 | Noble | 52/726.1 |
| 5,867,132 | A | * | 2/1999 | Blasing et al. | 343/890 |
| 5,920,291 | A | * | 7/1999 | Bosley | 343/892 |
| 5,971,345 | A | | 10/1999 | Khalaf | |

FOREIGN PATENT DOCUMENTS

| | | |
|---|---|---|
| DE | 33 27 185 | 11/1984 |
| FR | 2 780 816 | 1/2000 |
| GB | 2 327 863 | 2/1999 |
| JP | 63208301 | 8/1998 |
| WO | WO 99 45310 A | 9/1999 |
| WO | WO 99 60333 A | 11/1999 |

* cited by examiner

*Primary Examiner*—Leslie A. Braun
*Assistant Examiner*—Kofi Schulterbrandt
(74) *Attorney, Agent, or Firm*—Sughrue Mion, PLLC

(57) ABSTRACT

An antenna mounting device is provided to fasten an antenna to an external element (2). Two support members (3) are provided which may be attached to said external element (2) with a space in between. Each support member (3) has at least one cylindrical section (4) oriented in the direction of said space whereby a brace (10) of the antenna (1) may be attached onto said cylindrical section (4) by means of a fastening element (5) encompassing the same. This allows simple installation of antennas to walls, for example, with considerably lower installation requirements while having the same adjustment possibilities as with an auxiliary pole. For example, the antenna mounting device may be directly employed for fastening three antennas to one pole through completion of said antenna mounting device with a complementary support member.

4 Claims, 4 Drawing Sheets

ANTENNA MOUNTING DEVICE

The invention relates to an antenna mounting device comprising a support member which may be fastened to an external element and a brace for at least one antenna.

Antennas are fastened to a great variety of external elements, particularly to poles especially provided for antennas. The aforementioned antenna mounting device is disclosed in U.S. Pat. No. 5,641,141 wherein antennas oriented in different directions are mounted in a sleeve that is arranged on a pole.

An additional mounting device is disclosed in GB 2,327,863, which may be employed for different radii of curvatures on poles. The antenna itself is thereby rotatably inserted and mounted between upper and lower brackets provided therefor.

Finally, there is a mounting device disclosed in DE 33 27 185 for an antenna support member mounted to a pole whereby a tightening strap surrounds the antenna mast itself. Lateral orientation of the antenna is adjustable before tightening the tightening strap.

The known antenna mounting devices are all provided for the use on poles. However, it is nowadays more and more necessary that antennas are to be mounted on the [outside] walls of houses and other, at least partially, flat surfaces. The present technology provided for fastening antennas cannot be used for this purpose. Other types of fastening devices lead to higher assembly and storage requirements of the respective, different elements.

Based on this state-of-the-art, the invention has as its objective to provide a novel antenna mounting device whereby antennas may be fastened to any surfaces (external elements) without increased requirements for assembly and whereby especially the lateral adjustment, as disclosed in the pole mounting device, is available for the mounting onto walls as well.

This object is achieved according to the invention in that two support members are provided which may be fastened to the external element with a space in between, whereby each support member is provided with at least one cylindrical section oriented in the direction of said space, and whereby the brace of the antenna may be attached onto said cylindrical section by means of a fastening element encompassing the same.

By providing short sections of a rod or a pipe at the points of attachment near the wall, it is made possible to transfer the adjustability of the antenna also onto the wall mounting device with a low requirement in material and weight, as shown in the pole mounting device. The necessity for additional training is thereby low for the user of these systems since adjustment of the antenna may be performed in the same manner as in the mounting device for a pole.

An additional advantage of this device lies in the possibility to employ said device also in the mounting of three antennas on one pole through realization of two encompassing clamps having three cylindrical sections, for example.

Additional advantageous embodiments are characterized in the claims.

In the following, preferred embodiments of the invention are explained by way of example with the aid of accompanying drawings.

Figure 1:
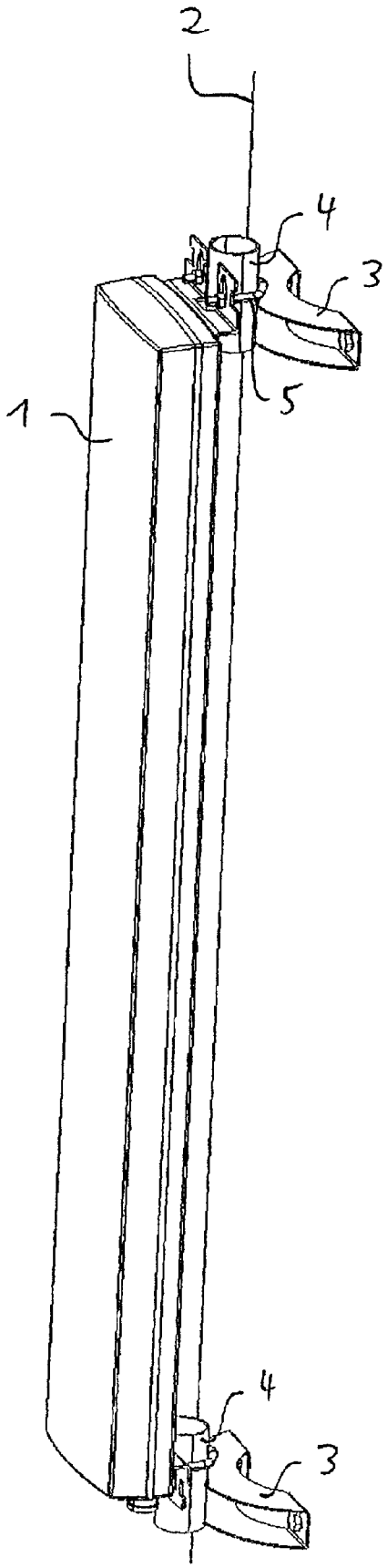
FIG. 1 shows an antenna mounting device according to the invention in a perspective view.

FIG. 1 shows a mounting device for fastening antennas 1 onto a wall 2, here a flat-top antenna. Since the walls 2 have only rarely the geographically necessary orientation for coverage of a mobile radio cell, auxiliary poles are oftentimes mounted on buildings whereby the antennas 1 may be turned into the desired direction. The complicated-constructed steel constructions of said auxiliary poles may be eliminated through the use of the mounting device for antennas described herein.

Said mounting device consists of two semi-circular U-shaped sheet-metal pieces 3 having the cylindrical sections 4 welded thereto and onto which said flat-cop antennas 1 are attached by means of U-bolts 5, and whereby said antennas 1 may be swiveled in their mounting device about the cylindrical section 4 without the employment of additional moveable parts. Semi-circular means thereby cover an angle through the arc of the sheet-metal piece 3 of preferably at least 120 degrees and at a maximum of 180 degrees.

Figure 2:
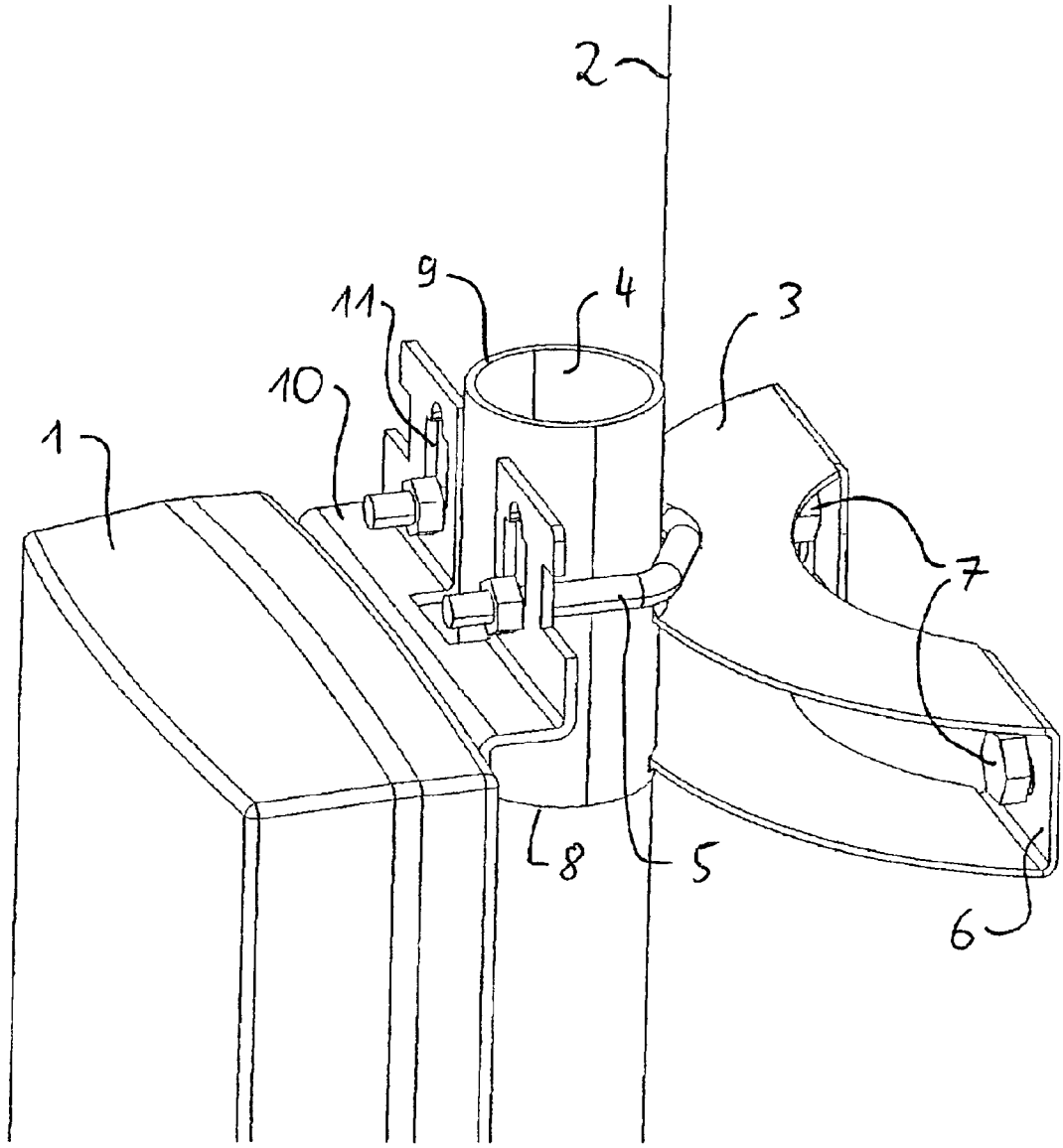
FIG. 2 shows an enlarged detailed view of the upper fastening element.

FIG. 2 shows a detailed view of the mounting device according to FIG. 1. The semi-circular U-shaped sheet-metal piece 3 may be easily identified whose legs are connected at the bottom by two face sections 6. Borings are provided in the face sections, for example, into which fastening bolts 7 are inserted whereby the antenna mounting device may be screwed onto the wall 2.

Since the cylindrical sections 4 are essentially even at their end 8 facing the ground with the U-shaped sheet-metal pieces 3, and since they have a protruding section 9 only on the opposite side, the S-shaped fastening piece 10 of the antenna 1 provided with a loose U-bolt 5 may be placed onto the two partial mountings and even be released afterwards in a very simple manner. The antenna 1 remains in place through its own weight and the U-bolt 5 only needs to be tightened subsequently. Thus, the tilt of the antenna 1 is adjustable before tightening of the bolt 5. In place of the S-shaped fastening piece 10, which forms a brace, this element 10 may also be integrated into the antenna 1 itself.

Traditional fastening material may be used for fastening of the antennas to the mounting devices. In this case, it consists of an S-shaped brace 10, for example, whereby slots 11 are provided on its one side into which the U-bolts 5 are attached and whereby the antenna 1 or the bottom side of the antenna 1 is attached on the opposite side of said brace 10.

The packaging volume and weight of the mounting device may be greatly reduced by the mounting device that is now separated into two cylindrical sections 4, which form together an auxiliary pole. The antennas, as in this case the antenna 1, may be turned in an infinitely variable manner by more than ±45 degrees, depending on its width. In place of the U-shaped sheet-metal piece 3, there are also other elements conceivable, such as L-shaped sheet-metal pieces. Of essence is the possibility that the cylindrical section 4 is to be fixedly attached to the support member 3 during the manufacturing of the antenna mounting device.

The advantage of this mounting device is in particular the fact that it consists only of two firmly connected parts whereby the same type of fastening may be used as in traditional mounting devices for poles, which means mounting straps and U-bolts. The antennas 1 may be hung and then tightly fastened in an installed mounting device by this arrangement of the cylindrical sections 4. Hence, the time for installation may be greatly reduced.

Figure 3:
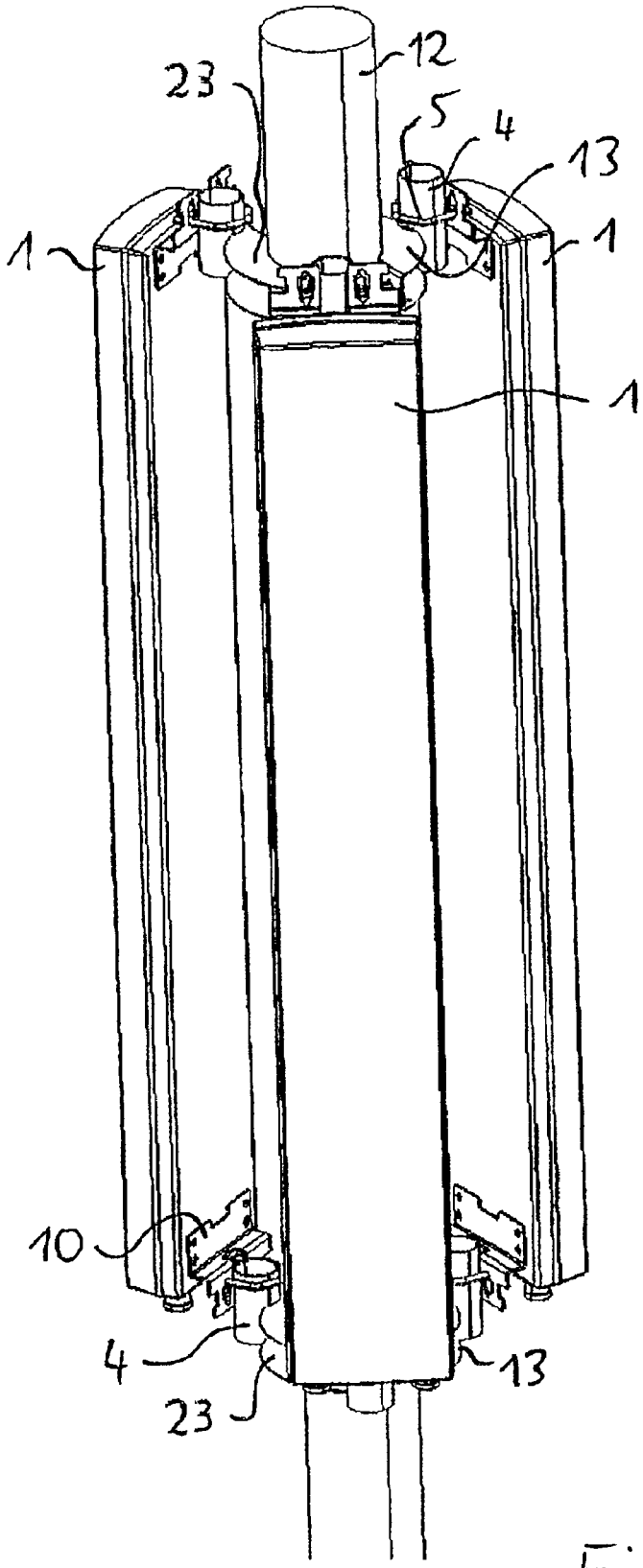
FIG. 3 shows a perspective view of an antenna mounting device receiving three antennas.

FIG. 3 shows a modification of the embodiment example illustrated in FIG. 1 and it shows here a mounting device for three antennas 1 surrounding one pole 12. In the case of mobile radio antennas, the antennas are oftentimes dispersed at one area in such a manner that the mobile radio cell, which is divided into three cells, is to be provided with three antennas at an angle of 120 degrees to one another. However, this is often not always possible to do at this angle of 120 degrees. With the hereby proposed mounting device for a pole, all antennas 1 may be turned independently from one another in their orientation by ±45 degrees, depending on the width of the antenna. Identical characteristics are identified with the same reference numerals in all figures.

The mounting device for fastening of three antennas 1 on one pole 12, as in FIG. 3, consists of pairs of two semi-circular U-shaped sheet-metal pieces 13 or 23 having a total of three cylindrical sections 4 welded thereto onto which the antennas 1 may be fastened by means of U-bolts 5. Said antennas are thereby swivable about the pole 12 in the mounting device without the need for moveable parts. The U-bolts 5 are fastened to the S-shaped fastening piece 10 according to the embodiment example in FIG. 1.

Figure 4:
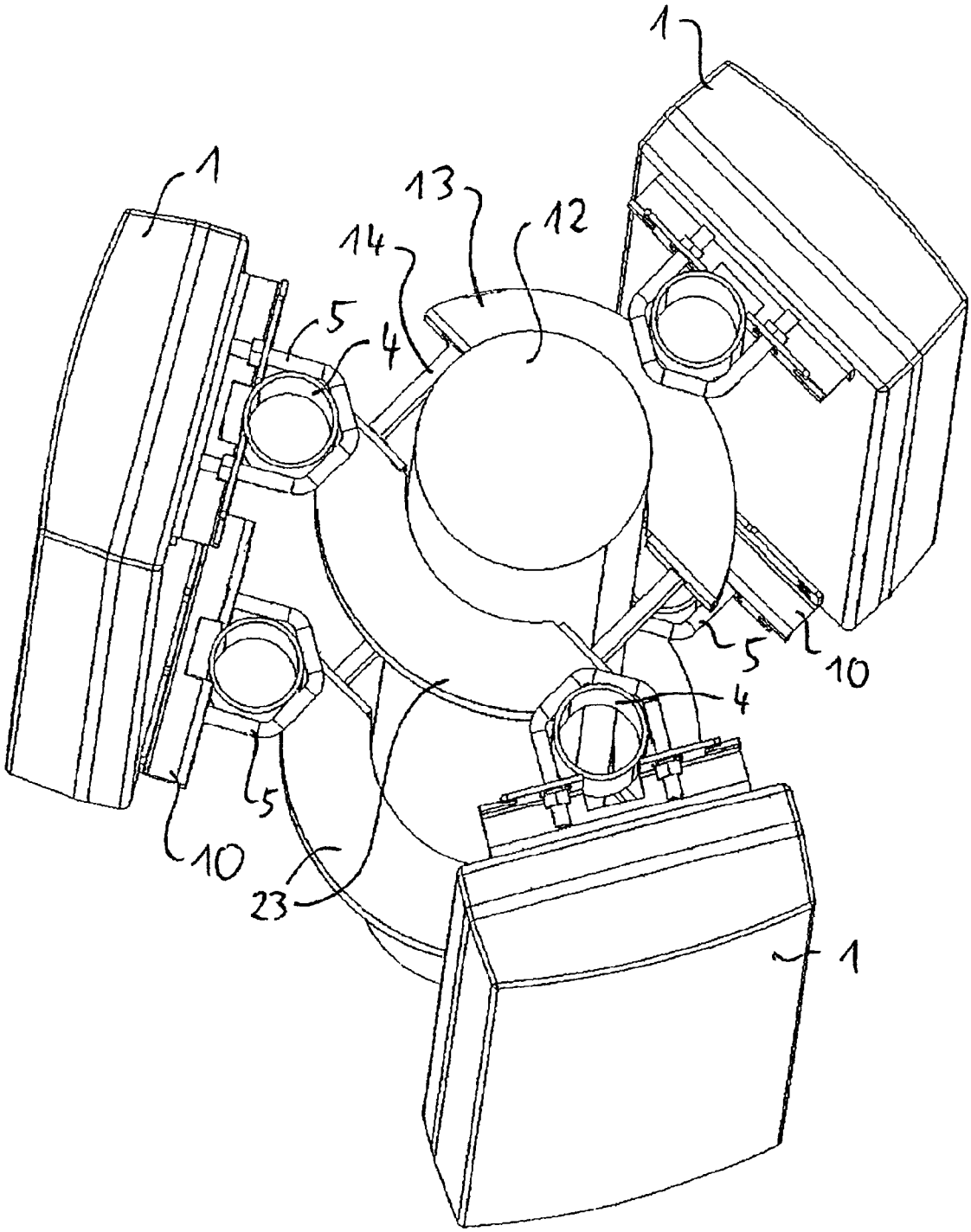
FIG. 4 shows a view at an angle from above onto the device in FIG. 3.

Two different semi-circular U-shaped sheet-metal pieces 13 or 23 are required for this purpose, which can be better seen in FIG. 4.

The advantage, compared to traditional auxiliary poles, consists especially in the fact that only one single mounting device has to be installed onto which three antennas 1, including tilting clamps, may be attached at the same height. The desired angles may be additionally adjusted in an infinitely variable manner.

FIG. 4 shows a view at an angle from above onto the device in FIG. 3. In particular, there can be seen that a semi-circular U-shaped sheet-metal piece 13 is employed on one side, which may be identical specifically to the U-shaped sheet-metal piece 3 of the embodiment example illustrated in FIG. 1 and FIG. 2. This means that the cylindrical section 4 is attached to the center of the U-shaped sheet-metal piece.

The second U-shaped sheet-metal piece 23, which is also semi-circular, supports here two cylindrical sections 4 at an angle of 120 degrees to one another, having here also a space of 60 degrees between the center to the side, respectively. Each of the U-shaped sheet-metal pieces 13 and 23 has face sections 6 whereby a threaded bolt/nut combination 14 is employed around an auxiliary pole 12 and also in the borings, which are placed on the faces 6, and whereby said bolt/nut combination is tightened around the pole 12 for fastening. One can immediately see that the semi-circular design of the sheet-metal pieces 3 are not absolutely necessary for mounting [the antenna] to the wall according to the embodiment example in FIG. 1, but there could also be employed L-shaped or otherwise formed sheet-metal pieces or braces. The use of a semi-circular sheet-metal piece 3 (having a coverage angle of 120 to 180 degrees along the arc, for example) allows the employment of said sheet-metal piece 3 as a support member 13 for pole mounting of three antennas together with a support member 23 designed in a similar manner.

What is claimed is:

1. An antenna mounting device comprising:

two support members configured to be fastened to an external element with a space in between said support members;

a brace for at least one antenna, wherein each support member comprises one cylindrical section oriented in the direction of said space, wherein the brace of said antenna is configured to be attached onto each of said two different cylindrical sections by means of a fastening element encompassing the same, wherein each support member forms an arc that covers an angle between 120 and 180 degrees, wherein each support member is a U-shaped sheet-metal piece, wherein one or all cylindrical sections are fixedly attached to the "U", and wherein legs of the "U" are connected to one another at the ends of the arc by face sections in which there are borings provided for fastening of the antenna mounting device to said external element, and wherein said external element is a cylindrical element whose outer contour substantially corresponds to the inner contour of the arcs of each support member, wherein a first cylindrical section is attached to a first U-shaped sheet-metal piece at the center of the arc, wherein a second and a third cylindrical section are attached to a second U-shaped sheet-metal piece at an angle of 60 degrees away from each other relative to the center of the arc, respectively, and wherein the two U-shaped sheet-metal pieces are connected to one another by a connection piece extending through the borings in the face section.

2. The antenna mounting device according to claim 1, wherein each cylindrical section protrudes past said support member whereby it may be attached to said external element in the direction of said space.

3. An antenna mounting device according to claim 1, wherein the cylindrical section is a pipe element.

4. An antenna mounting device according to claim 1, wherein said fastening element is a tightening strap or a U-bolt.

* * * * *